US007195421B2

(12) United States Patent
Dunbar

(10) Patent No.: US 7,195,421 B2
(45) Date of Patent: Mar. 27, 2007

(54) DEVICE FOR HOLDING PAVING BLOCKS

(76) Inventor: Gerald N. Dunbar, 15457 Ridgeway, Markham, IL (US) 60428

( * ) Notice: Subject to any disclaimer, the term of this patent is extended or adjusted under 35 U.S.C. 154(b) by 139 days.

(21) Appl. No.: 11/065,260

(22) Filed: Feb. 24, 2005

(65) Prior Publication Data

US 2006/0188330 A1 Aug. 24, 2006

(51) Int. Cl.
*E01C 11/22* (2006.01)

(52) U.S. Cl. ..... 404/8; 404/7; 47/33; 52/102

(58) Field of Classification Search ..... 404/7, 404/8; 47/33
See application file for complete search history.

(56) References Cited

U.S. PATENT DOCUMENTS

| | | | | |
|---|---|---|---|---|
| 696,792 | A | 4/1902 | Bedell | |
| 1,979,979 | A | 11/1934 | Martini | |
| 3,676,952 | A | 7/1972 | Watts | |
| 3,724,128 | A | 4/1973 | Tabone | |
| 4,824,068 | A | 4/1989 | Ferland | |
| 4,831,776 | A | 5/1989 | Fritch | |
| 4,846,437 | A | 7/1989 | Fitzgerald | |
| 4,863,307 | A | 9/1989 | Jones | |
| 5,157,867 | A | 10/1992 | Fritch | |
| 5,240,343 | A | 8/1993 | Strobl, Jr. | |
| 5,375,941 | A | 12/1994 | Strobl, Jr. | |
| 5,421,118 | A | 6/1995 | Bauer | |
| D391,299 | S | 2/1998 | Bragalone | |
| 5,769,562 | A | 6/1998 | Jones | |
| D400,985 | S | 11/1998 | Risi | |
| 5,930,947 | A | 8/1999 | Eckhoff | |
| 5,993,107 | A | 11/1999 | Bauer | |
| 6,030,144 | A * | 2/2000 | Cannella | 404/7 |
| D424,714 | S | 5/2000 | Hale | |
| 6,071,038 | A | 6/2000 | Strobl, Jr. | |
| 6,324,783 | B1 | 12/2001 | McIntyre et al. | |
| 6,767,159 | B2 | 7/2004 | Jones | |

* cited by examiner

*Primary Examiner*—Raymond Addie
(74) *Attorney, Agent, or Firm*—Gary R. Jarosik

(57) ABSTRACT

A device for holding paving blocks includes a front plate for contacting the paving blocks and a base plate for contacting a ground surface. Linking the front plate to the base plate is a plurality of support structures. Each support structure includes a boss member adapted to receive an anchor used to anchor the holding device to the ground surface, first and second support members which link the boss member to the face plate and which engage the face plate at opposed angles, and a third support member which links the boss member to the ground plate.

15 Claims, 4 Drawing Sheets

DEVICE FOR HOLDING PAVING BLOCKS

BACKGROUND

The following relates generally to a holding device for use in holding the edge of paving blocks or bricks.

As described in U.S. Pat. Nos. 5,240,343 and 5,375,941, paving blocks are commonly used in landscaping to achieve both a decorative and a utilitarian function. However, the natural freezing and thawing cycle of the ground upon which the paving blocks are laid, as well as vehicular and pedestrian traffic, causes movement of the paving blocks. Such movement of the paving blocks may cause a permanent displacement of the paving blocks to the detriment of the decorative and utilitarian function sought to be achieved.

SUMMARY

A device for holding paving blocks is disclosed which provides an improved means for inhibiting movement of the paving blocks. To this end, the device for holding paving blocks includes a front plate for contacting the paving blocks and a base plate for contacting a ground surface. Linking the front plate to the base plate is a plurality of support structures. Each support structure includes a boss member adapted to receive an anchor used to anchor the holding device to the ground surface, first and second support members which link the boss member to the face plate and which engage the face plate at opposed angles, and a third support member which links the boss member to the ground plate.

A better understanding of the objects, advantages, features, properties and relationships of the device for holding paving blocks will be obtained from the following detailed description and accompanying drawings which set forth illustrative embodiments which are indicative of the various ways in which the principles of the holding device may be employed.

BRIEF DESCRIPTION OF THE DRAWINGS

For a better understanding of the device for holding paving blocks described hereinafter, reference may be had to preferred embodiments shown in the following drawings in which.

DETAILED DESCRIPTION

With reference to the figures, wherein like numerals refer to like elements, a device for holding paving blocks is described. More particularly, the device for holding paving blocks 10 includes a front plate 12 which is adapted to engage the edge of paving blocks, such as bricks. To this end, the front plate 12 is substantially vertical, although it may be provided with a slight angle that causes the front plate 12 to exert a retaining force upon the edge of bricks positioned against the front plate 12. When utilized in connection with paving blocks in the form of bricks, it is preferred that the front plate 12 have a height of approximately two inches, approximately meaning within excepted manufacturing tolerances. Additional preferred measurements for the front plate 12 are a length of approximately ten feet and a thickness of approximately one-quarter inch. It will be understood that these dimensions, and others set forth hereinafter, may be changed to adapt the holding device 10 for other uses.

To support the holding device 10 upon a ground surface, the holding device 10 includes a base plate 14 that is linked to the front plate 12 by force transferring support structures which will be described hereinafter in greater detail. For engaging the ground surface, the base plate 14 is provided with a generally horizontal surface, i.e., one that is generally perpendicular to the front plate 12. In a preferred embodiment, the base plate 14 is in the form of a strip of material that is spaced from the front plate 12 thereby providing openings for grass and other vegetation to grow within the openings. In the exemplary embodiment, the base plate 14 also has a length of approximately ten feet and a width of approximately one-half inch. If it is desired to form a bendable member, the base plate 14 may be cut across its rear edge and, if required, a portion thereof removed. In this fashion, the bending can be achieved in a concave or convex fashion to go around curves formed by paving blocks. The cutting and/or removal of portions of the base plate 14 may be facilitated by providing the base plate 14 with pre-formed surfaces adapted to be easily cut or bent to break, e.g., lines of structural weakness.

Figure 1:
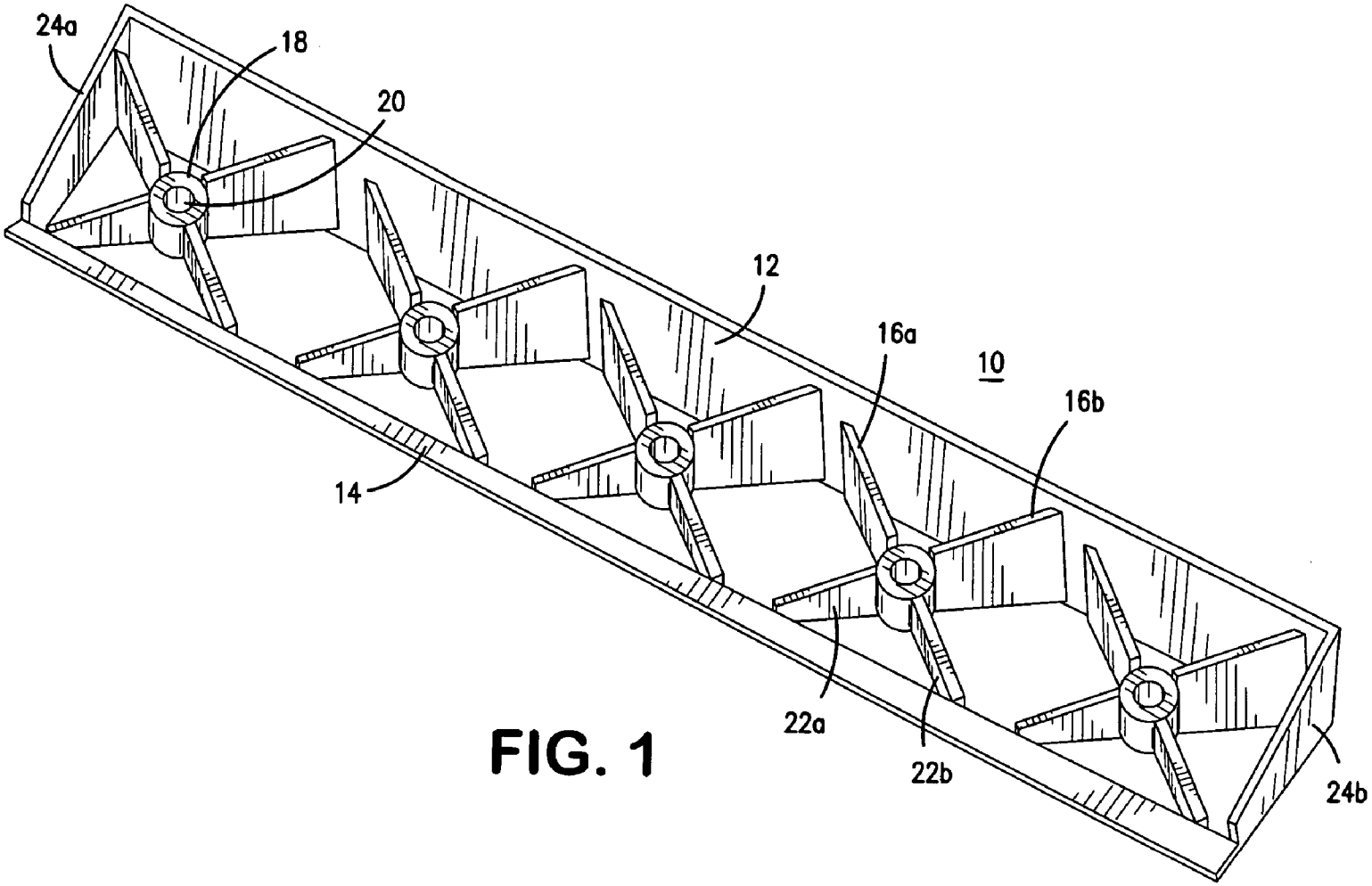
FIG. 1 is a perspective view of a paving block holder showing the new design.
Figure 2:
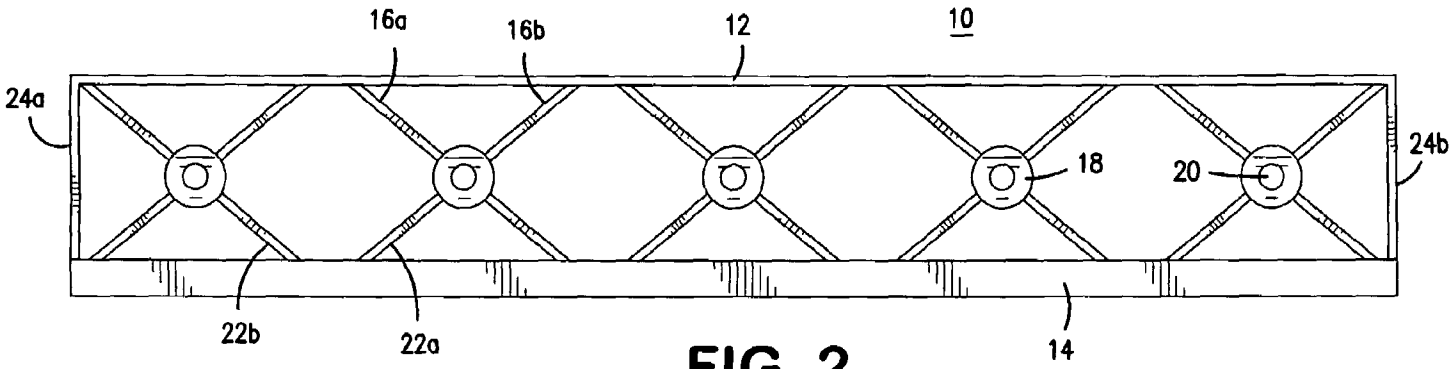
FIG. 2 is a top plan view of the paving block holder.
Figure 3:
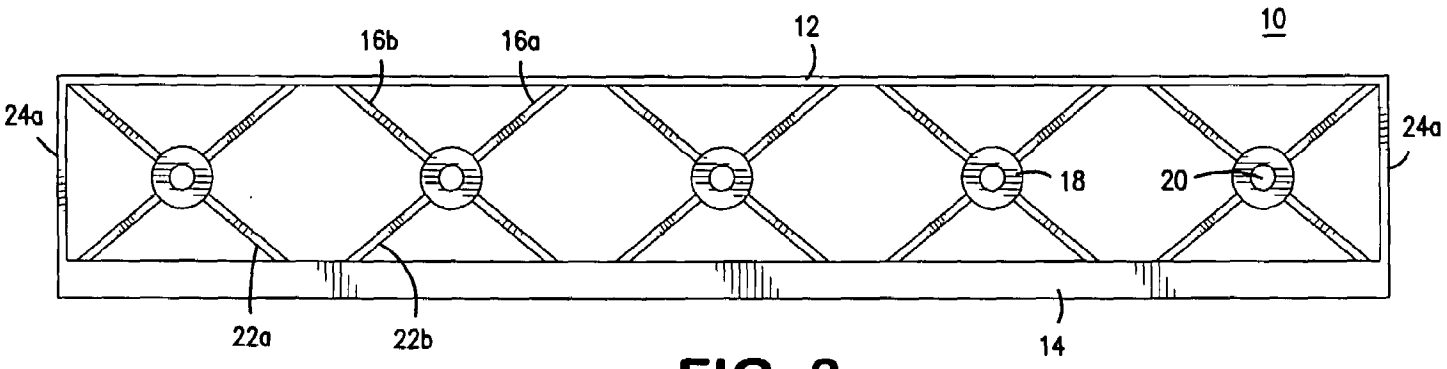
FIG. 3 is a bottom plan view of the paving block holder.
Figure 4:
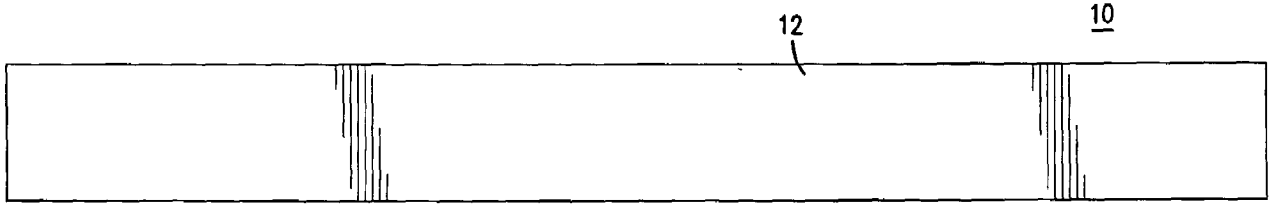
FIG. 4 is a front view of the paving block holder.
Figure 5:
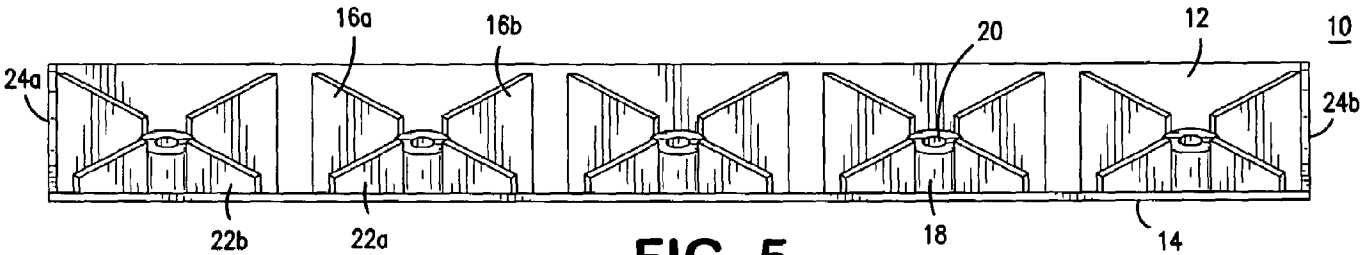
FIG. 5 is a rear view of the paving block holder.
Figure 7:
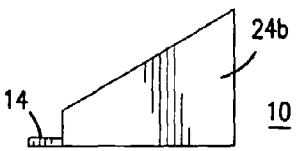
FIG. 7 is a right side elevational view of the paving block holder.
Figure 6:
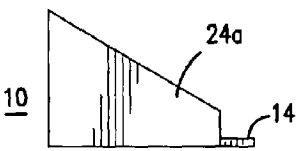
FIG. 6 is a left side elevational view of the paving block holder.
Figure 8:
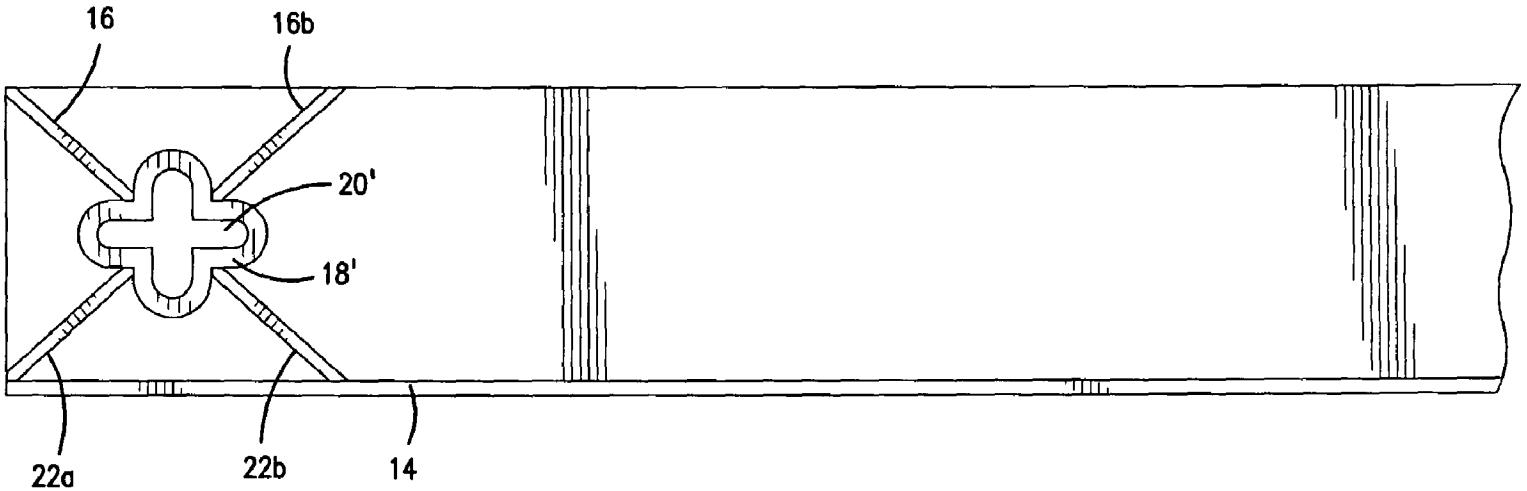
FIG. 8 illustrates a top view of a further embodiment of a boss of the paving block holder.

For transferring forces received at the front plate 12, for example from paving blocks under load, to the base plate 14, a plurality of support structures are provided which function to link the front plate 12 to the base plate 14. More particularly, the support structures comprise first and second upstanding support members 16*a*, 16*b* which engage the front plate 12 at an angle. As illustrated, the angles at which the first and second support members 16*a*, 16*b* engage the front plate 12 are opposed. The first and second upstanding support members 16*a*, 16*b* converge upon a boss member 18 which includes an aperture 20 for receiving a nail, spike, or the like type of anchor which is used to anchor the holding device 10 to the ground surface. Preferably, the aperture 20 formed in the boss member 18 is angled (at its top) towards the front plate 12 to provide added load bearing support. In the illustrated example, the boss member 18 is provided with an approximate diameter of one inch and the aperture 20, which may have a diameter of three-eighths of an inch, is provided with an angle of approximately ten degrees. The boss member 18' may also be adapted to include an aperture 20' that is, in turn, adapted to receive either a rounded spike or a flattened spike, such as a landscape spike, as seen in FIG. 8. As further illustrated, the apertures 20 of the respective boss members 18 of the support structures may be spaced by approximately five inches, which is seen to provide enhanced anchoring stability.

To further link the boss member 18 of the support structures to the base plate 14, the support structures include at least one upstanding support member 22. Preferably, the support structure includes third and fourth upstanding support members 22*a*, 22*b* which engage the base plate 14 at an angle. As illustrated, the angles at which the third and fourth support members 22*a*, 22*b* engage the base plate 14 are opposed. In this manner, when viewed from the top, the first, second, third, and fourth support members have the general appearance of an "X." When viewed from the side, the support members have a generally triangular shape which facilitates the transfer of load from the face plate 12 to the base plate 14. In the illustrated embodiment, an approximate five inch spacing is provided between the locations where the first and second support members 18*a*, 18*b* engage the face plate 12 and an approximate three and one-half inch spacing is provided between the locations where the third and fourth support members 22*a*, 22*b* engage the base plate 14. It is at the general location where the third and fourth support members meet the base plate 14 that deformations may be provided to the base plate 14 to facilitate the cutting/removal of portions of the base plate 14.

For use in connecting adjacently positioned holding devices 10, the holding device is preferably provided with side plates 24*a*, 24*b* which are provided with complimentary fastening structures. For example, one side plate 24*a* may be provided with a male attaching device while the other side plate 24*b* may be provided with a female attaching device that is adapted to receive the male attaching device to thereby securely join two adjacently positioned holding devices 10. When engaged, it is preferred that the side pate 24*a* of one holding device 10 be flush with the side plate 24*b* of the adjacent holding device 10. It will also be appreciated that it may be desired to provide the attaching devices with the ability to releasably lock two adjacent holding devices 10. For example, the male attaching device may be provided with a head and the female attaching device may be in the form of a circular hole having a downwardly extending channel which functions to prevent the head of the male attaching device from being moved perpendicularly with respect to the side plate 24*b*.

In order to make the holding device 10 any suitable process may be used. However, the unique shape of this device permits the use of injection molding of a plastic or synthetic resin to provide a strong device, which may be used in an efficient manner.

While the invention has been described with respect to the described embodiments in accordance therewith, it will be apparent to those skilled in the art that various modifications and improvements may be made without departing from the scope and spirit of the invention. Accordingly, it is to be understood that the invention is not to be limited by the specific illustrated embodiments.

All patents, patent applications, and other references cited within this document are hereby incorporated by reference in their entirety.

What is claimed is:

1. A holding device for paving blocks, comprising:

a front plate for contacting the paving blocks;

a base plate for contacting a ground surface; and a plurality of support structures for linking the front plate to the base plate, each support structure comprising a boss member adapted to receive an anchor used to anchor the holding device to the ground surface, first and second support members which link the boss member to the face plate and which engage the face plate at opposed angles, and a third support member which links the boss member to the ground plate.

2. The holding device for paving blocks as recited in claim 1, wherein each support structure comprises a fourth support member which links the boss member to the ground plate and wherein the third and fourth support members engage the ground plate at opposed angles.

3. The holding device for paving blocks as recited in claim 2, wherein the first, second, third, and fourth support members have the shape of an X.

4. The holding device for paving blocks as recited in claim 2, wherein the first and third support members have the general shape of a triangle.

5. The holding device for paving blocks as recited in claim 1, wherein the center of each boss member of the plurality of support structures is spaced by approximately five inches.

6. The holding device for paving blocks as recited in claim 1, wherein a portion of the base plate is severable to make the front plate flexible.

7. The holding device for paving blocks as recited in claim 1, wherein the front plate, base plate, and support structures are arranged to provide openings.

8. The holding device for paving blocks as recited in claim 1, wherein the front plate, base plate, and support structures are formed from an injection molded plastic material.

9. The holding device for paving blocks as recited in claim 1, comprising a pair of side plates positioned on opposed ends of the holding device between the front plate and the base plate, each of the pair of side plates having one piece of a fastening structure comprised of a pair of complimentary structures for allowing adjacent holding devices to be adjoined.

10. The holding device for paving blocks as recited in claim 1, wherein the front plate is provided with an angle towards an edge of the paving blocks.

11. The holding device for paving blocks as recited in claim 1, wherein the boss member has an aperture for accepting the anchor and the aperture is angled toward the front plate.

12. A holding device for paving blocks, comprising:

a front plate for contacting the paving blocks;

a base plate for contacting a ground surface; and a plurality of support structures for linking the front plate to the base plate, each support structure comprising a boss member adapted to receive an anchor used to anchor the holding device to the ground surface, first and second support members which link the boss member to the face plate and which engage the face plate at opposed angles, and third and fourth support members which link the boss member to the ground plate and which engage the base plate at opposed angles;

wherein a portion of the base plate is severable to make the front plate flexible and wherein the boss member has an aperture for accepting the anchor and the aperture is angled toward the front plate.

13. The holding device for paving blocks as recited in claim 12, wherein the front plate, base plate, and support structures are formed from an injection molded plastic material.

14. The holding device for paving blocks as recited in claim 12, comprising a pair of side plates positioned on opposed ends of the holding device between the front plate and the base plate, each of the pair of side plates having one piece of a fastening structure comprised of a pair of complimentary structures for allowing adjacent holding devices to be adjoined.

15. The holding device for paving blocks as recited in claim 12, wherein the front plate is provided with an angle towards an edge of the paving blocks.

* * * * *